US005788109A

United States Patent [19]

Borghini

[11] Patent Number: 5,788,109

[45] Date of Patent: Aug. 4, 1998

[54] SECURITY BOX HAVING SLIDING CLOSURE

[76] Inventor: Fabio Borghini, 9/C, Località Gaville, 52100 Arezzo, Italy

[21] Appl. No.: 750,537

[22] PCT Filed: Jun. 5, 1995

[86] PCT No.: PCT/IT95/00095

§ 371 Date: Dec. 13, 1996

§ 102(e) Date: Dec. 13, 1996

[87] PCT Pub. No.: WO95/34477

PCT Pub. Date: Dec. 21, 1995

[30] Foreign Application Priority Data

Jun. 15, 1994 [IT] Italy ..... FI940067 U

[51] Int. Cl.[6] ..... B65D 43/20

[52] U.S. Cl. ..... 220/347; 220/346; 220/351

[58] Field of Search ..... 220/346, 347, 220/351

[56] References Cited

U.S. PATENT DOCUMENTS

| | | | |
|---|---|---|---|
| 3,979,016 | 9/1976 | Frater . | |
| 5,129,538 | 7/1992 | Bennett | 220/346 |
| 5,458,256 | 10/1995 | Opheim | 220/345 |
| 5,593,036 | 1/1997 | Dyble et al. | 206/464 |

FOREIGN PATENT DOCUMENTS

| | | | |
|---|---|---|---|
| 0 285 720 | 10/1988 | European Pat. Off. . | |
| 0 484 294 | 5/1992 | European Pat. Off. . | |
| 1124388 | 2/1962 | Germany | 220/346 |
| 53824 | 1/1943 | Netherlands | 220/346 |
| Q 05 484 | 3/1916 | United Kingdom . | |

*Primary Examiner*—Stephen Cronin
*Attorney, Agent, or Firm*—Browdy and Neimark

[57] ABSTRACT

A container for the mailing and transport of objects, suited in particular to being closed with a seal, comprising a rigid, box-shaped body (1) opening at the top with a flanged edge (4) on which a cover slidingly engages up to a position of snapping shut. In said position, a first and a second hole (5, 15) formed respectively on the edge (4a) of the container (1) and on a side (14) of the cover (12) become aligned. Separation of the cover (12) from the container (1) is prevented by a sealed string or other equivalent means which ties the cover to the body by passing through the aligned holes (5, 15).

7 Claims, 3 Drawing Sheets

SECURITY BOX HAVING SLIDING CLOSURE

DESCRIPTION

1. Field of the Invention

The present invention relates to a container for the mailing and transport of objects, particularly suited to be closed with a seal.

2. Description of the Prior Art

Seals are frequently used in cases of mailing and transporting objects of various types, such as packages, boxes, trunks or entire train cars. The seals function not so much to prevent third parties from stealing or manipulating the goods as to allow the recipient to be certain that no one has altered the goods during the trip. In fact, the recipient need only verify that the seal is intact, such seal being even a simple lead sealed string or cord covered with sealing wax as well as any of the more sophisticated means. On the lead, sealing wax or other sealing means, codes, symbols or other signs are imprinted which are in the possession of only the persons responsible for mailing the package and which are difficult to falsify.

Normally, in order to mail packages with seals, it is not necessary for the package to have a specific form, but only that it be tied with a seal applied to the knot. However, when mailing goods of a certain importance, such as occurs frequently in the field of jewellery, there are no suitable containers which can be closed in a rational way with materials normally on hand.

In these cases, in fact, it is frequent to see containers suited to other purposes which are closed with adhesive tape, tied with string and then sealed in correspondence to the knot. In the case of customs inspections, even if the containers are resealed after the check, the closing and sealing are rarely carried out with the same care used by the person who prepared the package for mailing, with the risk of not being able to recognise possible subsequent tampering.

To overcome this inconvenience, types of containers, such as boxes in the form of small trunks, are known which are suited for being closed and sealed in a rational manner. They have a top opening from the edges of which pins protrude which are made to engage in holes formed in a corresponding cover. At the ends of the pins, holes are present which, once the cover is introduced, can be tied by means of seals so that it is impossible to extract the cover from the pins without breaking them. This type of sealable container, however, requires that every time it is closed as many seals as protruding pins (normally 4 to 6) be applied. Therefore, in the case of mailing many containers, the execution of the seals can be rather time consuming. Furthermore, the cover often vibrates with respect to the container since the seals are not able to block it sufficiently.

A particularly practical container is described in EP 0484294 and comprises a flat box having an upper opening closed by a slidably engageable cover. The box on opposite side walls has projections engaging with a plurality resilient appendages provided on two opposite edges of the cover, so that they can clamp on each other. Even if it is designed for containing electronic equipment, and for this reason it comprises an annular rubber element put between the cover and the box, it could be suitable also for being tied and sealed through two aligned holes respectively provided for in the box and in the cover and engaging with a screw. However, many portions of the perimeter of the container offer possible ways for entering the container with thin flexible gripping means, or with sucking means, and steal small gold pieces, small jewels or precious stones without neither cutting the seal or damaging the box.

SUMMARY OF THE INVENTION

The object of the present invention is to provide a container for the mailing and transport of objects which is suited to be closed even with a single seal, which allows for rapid application of the cover without being able to oscillate during transport and which, at the same time, can be easily closed and sealed again after possible inspections, offering no ways through which it can be entered without cutting the seal or damaging the box.

This object is accomplished by the container according to the invention the novel feature of which is that it comprises a rigid, box-shaped body open at the top with a flanged border on which a cover slidingly engages up to a position where it snaps shut. In such closed position, a first and second hole formed respectively on the edge of the container and on the cover become aligned. The cover comprises two opposite sides bent for all their length substantially in the shape of a "C" suited to constitute a sliding guide For the two opposite portions of the edge of the box-shaped body adjacent to the portion containing said first hole. The side of the cover containing said second hole comprises means to snap into engagement with the portion of edge containing said first hole.

BRIEF DESCRIPTION OF THE DRAWINGS

The invention will be illustrated with the following description of one of its possible embodiments, given as an example and not limitative, with reference to the attached drawings in which.

DESCRIPTION OF THE PREFERRED EMBODIMENT

Figure 1A:
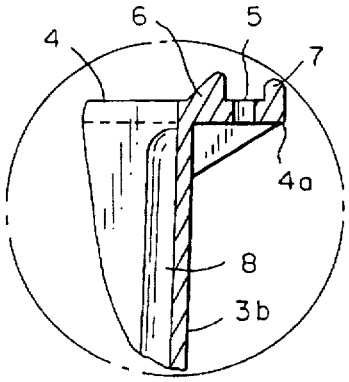
FIG. 1 is an exploded transversal sectional view of the container according to the invention, with a detailed view of a portion of the edge.
Figure 1:
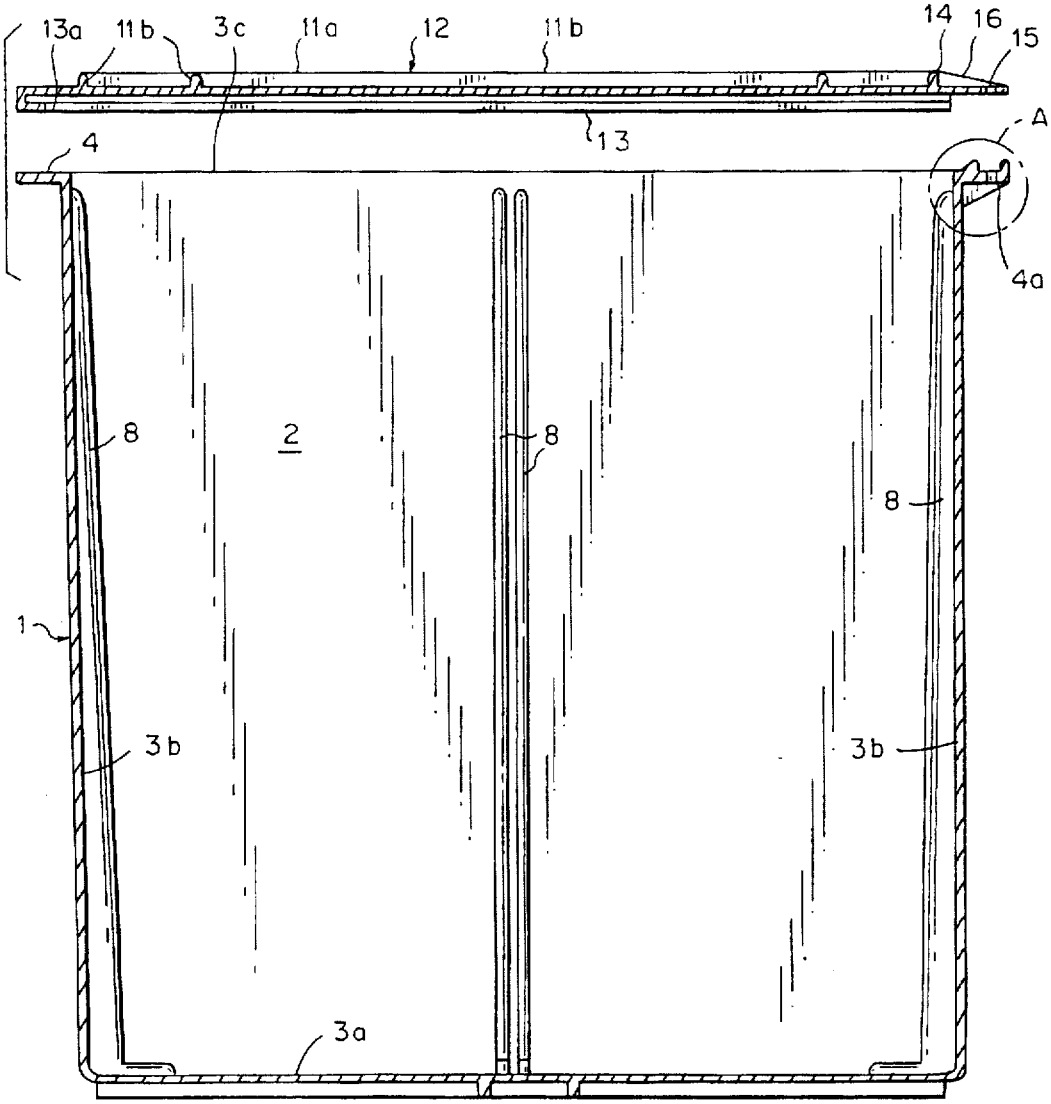
Figure 2:
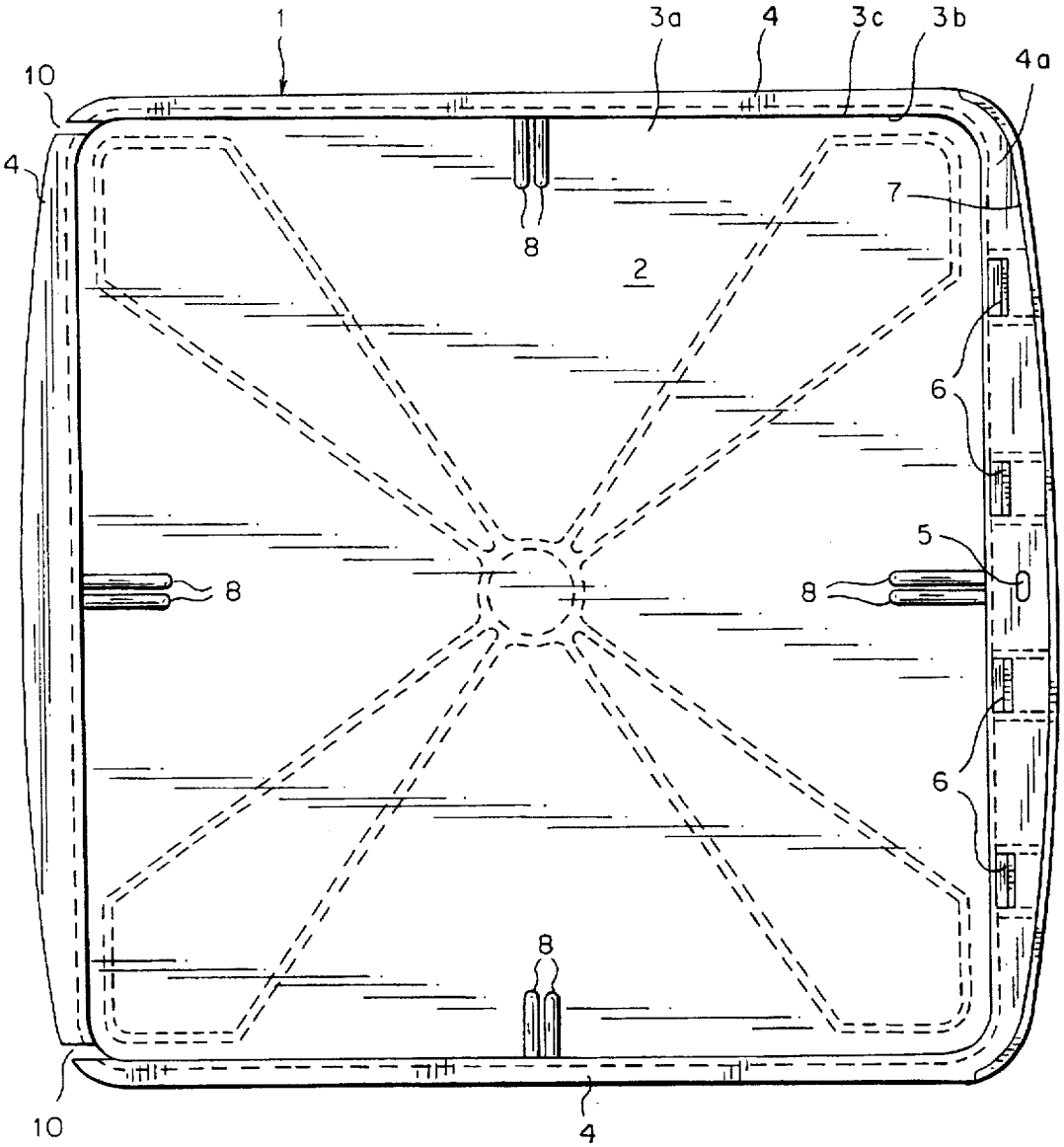
FIG. 2 is a top plan view of the box-shaped body of the container of FIG. 1.

With reference to the above-mentioned figures, a container according to the present invention comprises a box-shaped body 1 having an internal space 2 suited to contain various types of objects. Body 1 has a bottom 3*a* reinforced by stiffening ribs, lateral walls 3*b* and only a top opening delimited by an edge 3*c*. Edge 3*c* is flanged or, in other words, presents flat protrusions 4 orthogonal to lateral walls 3*b*. As can be seen in FIGS. 1 and 2, a portion 4*a* of said edge comprises a central hole 5 and four teeth 6 having a substantially triangular cross-section, located symmetrically with respect to hole 5. Additionally, in correspondence with the end of portion 4*a* of edge 4, a lip 7 is present protruding from the same side as teeth 6. Guides 8 for inserting septa (not shown) to divide space 2 into smaller spaces as well as notches 10 suited to engage with ribs 11*a* of a cover 12 which will be described below are also shown.

Figure 3:
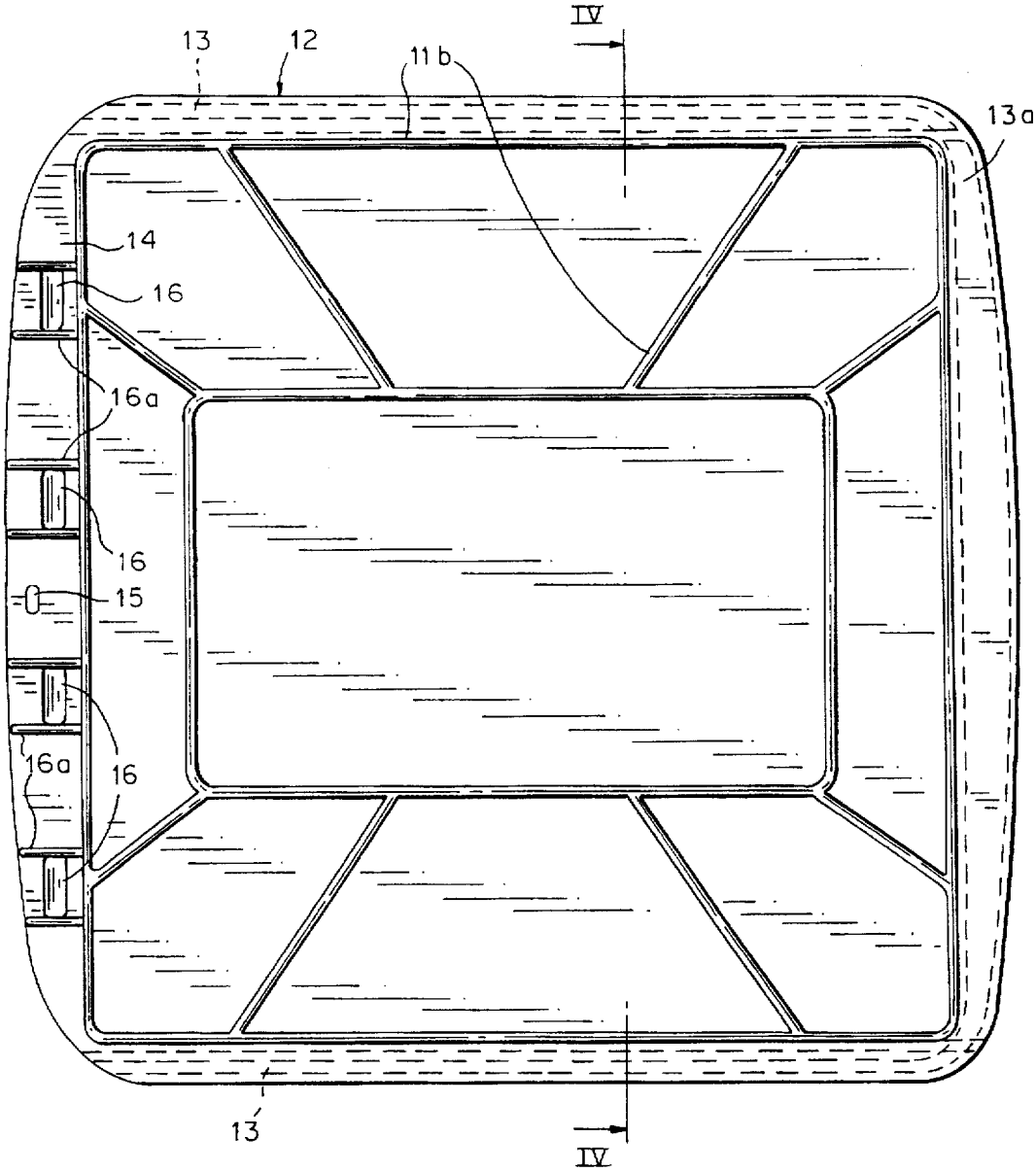
FIGS. 3 and 4 are respectively a top plan view and a longitudinal sectional view according to arrows IV—IV of FIG. 3 of the cover of the container of FIG. 1.
Figure 4:
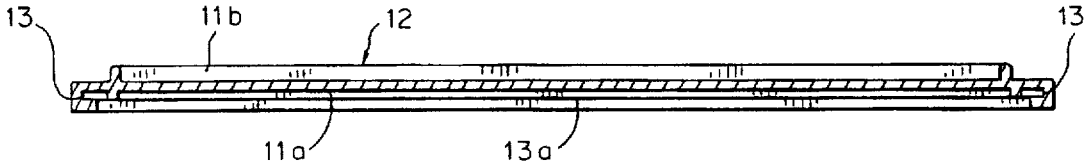

With reference to FIGS. 3 and 4, cover 12 is substantially flat with internal stiffening ribs 11*a* and external stiffening ribs 11*b*. External to the perimeter of ribs 11*a*, cover 12 has two opposite sides 13 bent substantially in the shape of a "C" from the opposite side of ribs 11*b* (FIG. 4). Also a third side 13*a* is bent in the shape of a "C" (FIGS. 1 and 3), whereas a fourth side, indicated with 14, is flat and has a central hole 15 at the sides of which four cavities 16 are present which have a triangular cross-section and are symmetrical with respect to hole 15. Cavities 16 are each comprised between small guide ribs 16*a* for teeth 6 during the fitting of cover 12 to body 1.

After container 1 has been filled with the goods to be transported or mailed, it can be closed by cover 12 inserting edges 4 in sides 13. At the end of sliding, as is shown in FIG. 1, side 14 of cover 12 meets teeth 6 which engage with a snap in cavities 16. Lip 7 forces side 14 slightly upward preventing cover 12, as a result of the space remaining between sides 13 and edges 4 of body 1, from vibrating with respect to container 1. Side 13*a*, opposite side 14 of cover 12, hugs edge 4 of container 1 from the opposite side of portion 4*a*. In this blocking position, holes 5 and holes 15 coincide perfectly, and, between them, it is possible to pass a portion of string (not shown) to be subsequently sealed. in this position, cover 12 cannot be released from teeth 5 and slid to open container 1 without breaking said string, therefore accomplishing the established object of the invention. In fact, the presence of sides 13 and 13*a* bent to the shape of a "C" prevents any kind of withdrawal if not in the direction of sliding opposite the insertion described above. The breaking of sides 13 and C-shaoed sides 13*a*, which would be necessary in order to lift cover 12 without breaking the seal, would be equivalent to breaking the seal itself, since it would be perfectly visible to the recipient of the goods.

Body 1 and cover 12 may advantageously be produced in hard plastic by means of injection moulding. The container according to the invention can, therefore, be manufactured at low cost and without prejudicing in any way its functionality. Thus, an elongated seal can be used to secure the container by passing it through the first hole 5 and the second hole 6 when the cover 12 and the body 1 are aligned in their closure position to cover the perimeter of the open top. The C-shape of the cover 12 slidably engages the lateral portions of the flanged edge 4 of the body 1. The means to snap into engagement with the flanged edge 4 of the body 1 can includes plural discrete snaps 6 and 16. A rear portion of the body is opposite the front portion including the first hole 5.

Although reference has been made to a coupling of edges 4 and sides 13 due to their respectively flat and C-shaped forms, the possibility of giving them a form of engagement of equivalent reciprocal sliding, as long as it is suited to prevent withdrawal in any direction different from that of the sliding followed during insertion, cannot be excluded.

The invention is not limited to the embodiment described and illustrated above, but comprises any and all variations of execution.

I claim:

1. A container for mailing and transport of objects and adapted for sealing with an elongated seal: the container comprising:

(a) a rigid box-shaped body (1) having an open top, the body including a flanged edge (4) extending outwardly from a perimeter of the open top, the flanged edge (4*a*) comprising a sealing first hole (5); and (b) a cover (12) alignable with the body into an aligned closure position wherein the cover closes the entire open top;

the cover including an outwardly extending side (14), the side including a sealing second hole (15), the second hole being aligned with the first hole when the cover and the body are aligned in the closure position, wherein the seal is insertable through the first hole and the second hole; and (c) a sliding guide for the cover to slidingly engage the body up to the aligned closure position in which the first hole is aligned with the second hole;

whereby when the seal is passed through the first hole and the second hole in the aligned position, the cover cannot be removed without breaking the seal;

wherein the outwardly extending side (14) of the cover comprises means to snap into engagement with the flanged edge of the body, and disengagement requires separation of the first hole and the second hole, whereby the seal is broken.

2. The container according to claim 1, wherein the means to snap into engagement with the flanged edge of the body comprises a plurality of discrete snaps.

3. The container according to claim 2, wherein each of the snaps comprises a tooth (6) protruding from the flanged edge of the body and a cavity formed on the extending side of the cover.

4. A container for mailing and transport of objects and adapted for sealing with an elongated seal; the container comprising:

(a) a rigid box-shaped body (1) having an open top, the body including a flanged edge (4) extending outwardly from a perimeter of the open top, the flanged edge (4*a*) comprising a sealing first hole (5); and (b) a cover (12) alienable with the body into an aligned closure position wherein the cover closes the entire open top;

the cover including an outwardly extending side (14), the side including a sealing second hole (15), the second hole being aligned with the first hole when the cover and the body are aligned in the closure position, wherein the seal is insertable through the first hole and the second hole; and (c) a sliding guide for the cover to slidingly engage the body up to the aligned closure position in which the first hole is aligned with the second hole;

whereby when the seal is passed through the first hole and the second hole in the aligned position, the cover cannot be removed without breaking the seal;

wherein the flanged edge includes lateral portions extending along two opposite sides of the body, and wherein the sliding guide comprises a C-shape (13) of the cover slidably engaging the lateral portions.

5. The container according to claim 4, wherein the flanged edge includes a rear portion of the body opposite the first hole and wherein the C-shape (13*a*) engages the rear portion in the closure position.

6. A container for mailing and transport of objects and adapted for sealing with an elongated seal; the container comprising:

(a) a rigid box-shaped body (1) having an open top, the body including a flanged edge (4) extending outwardly from a perimeter of the open top, the flanged edge (4*a*) comprising a sealing first hole (5); and (b) a cover (12) alignable with the body into an aligned closure position wherein the cover closes the entire open top;

the cover including an outwardly extending side (14), the side including a sealing second hole (15), the second hole being aligned with the first hole when the cover and the body are aligned in the closure position, wherein the seal is insertable through the first hole and the second hole; and (c) a sliding guide for the cover to slidingly engage the body up to the aligned closure position in which the first hole is aligned with the second hole;

whereby when the seal is passed through the first hole and the second hole in the aligned position, the cover cannot be removed without breaking the seal;

wherein the flanged edge comprises a lip (7) on a front portion thereof opposite a rear portion.

7. A container for mailing and transport of objects and adapted for sealing with an elongated seal; the container comprising:

(a) a rigid box-shaped body (1) having an open top, the body including a flanged edge (4) extending outwardly from a perimeter of the open top, the flanged edge (4*a*) comprising a sealing first hole (5); and (b) a cover (12) alienable with the body into an aligned closure position wherein the cover closes the entire open top;

the cover including an outwardly extending side (14), the side including a sealing second hole (15), the second hole being aligned with the first hole when the cover and the body are aligned in the closure position, wherein the seal is insertable through the first hole and the second hole; and (c) a sliding guide for the cover to slidingly engage the body up to the aligned closure position in which the first hole is aligned with the second hole;

whereby when the seal is passed through the first hole and the second hole in the aligned position, the cover cannot be removed without breaking the seal;

wherein the sliding guide includes notches (10) on the body engaging ribs (11*a*) on the cover.

* * * * *